US005451114A

United States Patent [19]

Ishigaki

[11] Patent Number: 5,451,114

[45] Date of Patent: Sep. 19, 1995

[54] LIQUID APPLICATOR AND A CAP THEREOF

[75] Inventor: Masayuki Ishigaki, Minamikawachi, Japan

[73] Assignee: Kabushiki Kaisha Sakura Kurepasu, Osaka, Japan

[21] Appl. No.: 240,388

[22] Filed: May 10, 1994

Related U.S. Application Data

[63] Continuation of Ser. No. 24,947, Mar. 2, 1993, abandoned.

[30] Foreign Application Priority Data

Mar. 2, 1992 [JP] Japan ..... 4-020024 U

[51] Int. Cl.[6] ..... B43K 9/00

[52] U.S. Cl. ..... 401/202; 401/213; 401/243; 401/247

[58] Field of Search ..... 401/202, 213, 247, 246, 401/245, 244, 243

[56] References Cited

U.S. PATENT DOCUMENTS

| | | | |
|---|---|---|---|
| 3,459,485 | 8/1969 | Rigondaud | 401/246 |
| 3,554,658 | 1/1971 | Malm et al. | 401/202 X |
| 3,592,552 | 7/1971 | Malm | 401/202 |
| 4,759,651 | 7/1988 | Manusch et al. | 401/247 X |

FOREIGN PATENT DOCUMENTS

| | | | |
|---|---|---|---|
| 3223722 | 12/1983 | Germany | 401/202 |
| 635537 | 4/1983 | Switzerland | 401/243 |
| 631195 | 10/1949 | United Kingdom | 401/244 |

*Primary Examiner*—Steven A. Bratlie
*Attorney, Agent, or Firm*—Fish & Richardson

[57] ABSTRACT

A lead portion 18 and a cap mounting portion 34 are provided at a lead end portion of a main shaft 10 of a liquid applicator. A projected portion 36 is formed on an outer circumferential surface of the cap mounting portion 34, A cap mountable to this main shaft is formed with lines of projection 30, 32 on inner circumferential surfaces of bottom and intermediate end portions thereof respectively. The projection 30 is movable over the projected portion 36, whereas the projection 32 is engageable with an outer circumferential surface 19 of the lead portion 18. The respective portions are positioned relative to one another such that the projection 32 is engageable with the outer circumferential surface 19 after the projection 30 moves over the projected portion 36. Accordingly, there can be prevented a loss of airtightness in the cap due to an incomplete cap mounting operation without impairing the facility to mount the cap to the main shaft.

6 Claims, 5 Drawing Sheets

LIQUID APPLICATOR AND A CAP THEREOF

This application is a continuation of Ser. No. 08/024,947, filed Mar. 2, 1993, now abandoned.

BACKGROUND OF THE INVENTION AND RELATED ART STATEMENT

This invention relates to liquid applicators including ball-point pens and paint markers, and caps thereof.

FIG. 6 is an example of a mounting structure of a cap in a conventional liquid applicator. The illustrated cap 80 is formed of an elastically deformable material such as a synthetic resin, and includes a hollow bottom cylindrical portion 81 and a hollow lead cylindrical portion 82 having a smaller diameter than the bottom cylindrical portion 81. The lead cylindrical portion 82 is formed axially continuously with the bottom cylindrical portion 81. An inner circumferential surface 83 of the lead cylindrical portion 82 is formed into a tapered surface whose diameter decreases as it extends toward a lead end of the cap (to the left in FIG. 6). At an inner circumferential surface of a bottom end of the bottom cylindrical portion 81, there are formed a plurality of ribs (four in this illustrated example) 84 which are spaced apart circumferentially and project inward.

A main shaft 90 includes a casing 91 for containing ink therein and a lead portion 92 mounted at a lead end of the casing 91. A nib 93 projects out of a lead end face of the lead portion 92, and a line of projection 94 is formed at an outer circumferential surface of the casing 91. The projection 94 extends entirely over the circumferential surface of the casing 91, and projects outward. In this example, an inside diameter of a circumferential trace of the ribs 84 is larger than an outside diameter of the casing 91 and smaller than an outside diameter of the projection 94. An outside diameter of the lead portion. 92 is smaller than an inside diameter of a bottom end of the lead cylindrical portion 82 and larger than an inside diameter of a lead end of the cylindrical portion 82.

The respective portions are positioned relative to one another as follows. When the cap 80 is mounted on the lead end of the main shaft 90 from the bottom end thereof, the ribs 84 come to contact with the projection 84. Before the ribs 84 moves over the projection 94, the lead end of the lead portion 92 comes to contact with the tapered inner circumferential surface 83 of the lead cylindrical portion 82, thereby holding an interior of the lead cylindrical portion 82 airtight. Thereafter, the ribs 84 move over the projection 94, and the lead portion 92 is completely fitted in the lead cylindrical portion 82.

Both the lead cylindrical portion 82 and the ribs 84 of the cap 80 are fitted to the corresponding portions of the main shaft 90 for the following reasons. The interior of the lead cylindrical portion 82 is held airtight by completely fitting the lead portion 92 into the lead cylindrical portion 82. A user is allowed to confirm the completion of the cap mounting operation by a sound or touch generated when the ribs 84 move over the projection 94.

In the above liquid applicator, an axial force required to move the ribs 84 over the projection 94, i.e. to complete the fitting of the cap to the main shaft, (hereinafter referred to a fitting strength) is a sum of a force to bend the ribs 84 radially outward along the projection 94 and a force required to fit the lead portion 92 compressively into the lead cylindrical portion 82 as much as to displace the cap 80 axially relative to the main shaft 90 when the ribs 84 move over the projection 94. If this fitting strength is exceedingly larger, a large force must be applied so as to mount the cap to the main shaft, with the result that the operability of the liquid applicator is deteriorated. In other words, the fitting strength needs to be adjusted accurately in order to mount the cap 80 properly. In view of this, the cap 80 is not formed with a projection extending entirely over the inner circumference thereof but a plurality of ribs 84 spaced apart circumferentially. This reduces a contact area of the ribs 84 with the projection 94, thereby reducing the fitting strength.

However, in this structure, the user may determine mistakenly that the cap fitting operation has been completed by a touch the user feels when the ribs 84 come to contact with a lead end face of the projection 94 (i.e., immediately before the ribs 84 move over the projection 94), and may stop the cap fitting operation. Since the lead portion 92 is not yet fitted to the inner circumferential surface 83 of the lead cylindrical portion 82 at this time and the ribs 84 are spaced apart without extending continuously circumferentially, the interior of the lead cylindrical portion 82 cannot be held airtight. Thus, the liquid applicator suffers the problems that the nib 93 gets dry and the ink in the main shaft 90 evaporates when being left in this state for a long time.

As a means for avoiding the above problems, it can be considered to form a projection extending continuously circumferentially in place of the ribs 84 and to perform a fine adjustment of the fitting strength by setting a projected amount of this projection. However, in order to adjust the fitting strength finely in this manner, both of the projections must be sized precisely, thereby necessitating an increase in the cost. Further, in this structure, the interior of the lead cylindrical portion 82 is held airtight constantly during a time which lasts until the cap fitting operation is completed after the projection formed in place of the ribs 84 comes to contact with the projection 94. Accordingly, the pressure in the lead cylindrical portion 82 is increased excessively by the axial displacement made in mounting the cap 80 to the main shaft 90. Thus, when the cap 80 is detached from the main shaft 90 next, the pressure around the nib 93 is reduced drastically to as low as an atmospheric pressure. This may cause an excessive ink flow inadvertently.

SUMMARY OF THE INVENTION

In view of the problems residing in the prior art, it is an object of the invention to provide a liquid applicator and a cap thereof which are capable of preventing a loss of airtightness in the cap due to the incompletely mounted cap while allowing the cap to be mounted to a main shaft of the liquid applicator easily and readily and, more preferably, to provide a liquid applicator and a cap thereof which are capable of preventing the problems of an excessive pressure in the cap when the cap is mounted and an excessive flow of liquid to be applied associated therewith when the cap is detached.

Accordingly, the invention is directed to a liquid applicator comprising a main shaft having a liquid applying portion at a lead end thereof; a cap detachably mountable to a lead end portion of the main shaft in such a manner as to cover the liquid applying portion; first and second shaft fitting portions formed at the main shaft at different positions; and first and second cap fitting portions formed at the cap formed at different positions. The first shaft and cap fitting portions are movable over each other and seal an interior of the cap when they are in contact with each other over the circumferences thereof. The second shaft and cap fitting portions are engageable with each other and seal the interior of the cap in their engaged state. The first shaft and cap fitting portions and the second shaft and cap fitting portions are positioned relative to each other such that the second shaft and cap fitting portions are engageable with each other only after the first shaft and cap fitting portions move over each other.

With the liquid applicator and the cap thereof thus constructed, a user is allowed to confirm the completion of the cap mounting operation by a sound, a touch, or the like generated when the first cap fitting portion moves over the first shaft fitting portion and the second cap fitting portion is engaged with the second shaft fitting portion due to an inertia force acting thereafter. In other words, the second cap and shaft fitting portions are not engaged with each other until the first cap fitting portion moves over the first shaft fitting portion completely. Accordingly, an axially acting external force required to move the first cap fitting portion over the first shaft fitting portion becomes smaller compared to a conventional liquid applicator in which the second cap and shaft fitting portions are engaged with each other while the first cap fitting portion is moving over the first shaft fitting portion. Thus, even if the first cap and shaft fitting portions come to contact with each other over the entire circumferences thereof, an exceedingly large fitting strength is not required and therefore the facility to mount the cap in not impaired in this liquid applicator.

Accordingly, even if the user stops the cap mounting operation mistakenly when the first cap fitting portion comes to contact with the first shaft fitting portion, i.e. immediately before the first cap fitting portion moves over the first shaft fitting portion, the interior of the cap can be held airtight since the first cap and shaft fitting portions are in contact with each other over the entire circumferences thereof. In addition, both drying of the liquid applying portion and evaporation of the liquid to be applied in the main shaft can be prevented.

If engagement of the second cap and shaft fitting portions is started while the first cap and shaft fitting portions are in contact after moving over each other, the interior of the cap is kept sealed after the first cap and shaft fitting portions first come to contact with each other. Thus, the air in the sealed cap is compressed according to the axial displacement of the cap toward the bottom end of the liquid applicator when the cap is mounted.

In view of this, it is preferable to locate the first shaft and cap fitting portions more toward a bottom end of the liquid applicator than the second shaft and cap fitting portions respectively, and to make the second shaft and cap fitting portions engageable with each other only after the first shaft and cap fitting portions move over each other and the first cap fitting portion is spaced away from the first shaft fitting portion toward the bottom end of the liquid applicator.

With this arrangement, the second cap and shaft fitting portions are engaged with each other when the first cap and shaft fitting portions are spaced apart after moving over each other. Accordingly, the air in the cap escapes through a clearance between the first cap and shaft fitting portions immediately before the second cap and shaft fitting portions are engaged with each other, thereby preventing the pressure in the cap from increasing to an exceedingly high level. This in turn prevents an excessive flow of the liquid to be applied after the cap is detached from the main shaft.

Further, it may be advantageous to form one of the first shaft and cap fitting portions to have such a tapered surface that a projected amount thereof increases as it extends toward a top thereof, and to form the other fitting portion to be in contact with the tapered surface over an entire circumference thereof before reaching the top and to seal the interior of the cap in this contact state.

With this arrangement, the other fitting portion comes to contact with the tapered surface reliably before the first shaft and cap fitting portions move over each other. Thus, the interior of the cap can be held airtight more reliably.

The invention is also directed to a cap of each liquid applicator described above.

These and other objects, features and advantages of the present invention will become more apparent upon a reading of the following detailed description and accompanying drawings.

DETAILED DESCRIPTION OF THE PREFERRED EMBODIMENTS OF THE INVENTION

An embodiment of the invention will be described with reference to the accompanying drawings. The invention is applicable to any of various types of liquid applicators having a lead portion mounted with a cap such ball-point pen and paint markers.

Figure 2:
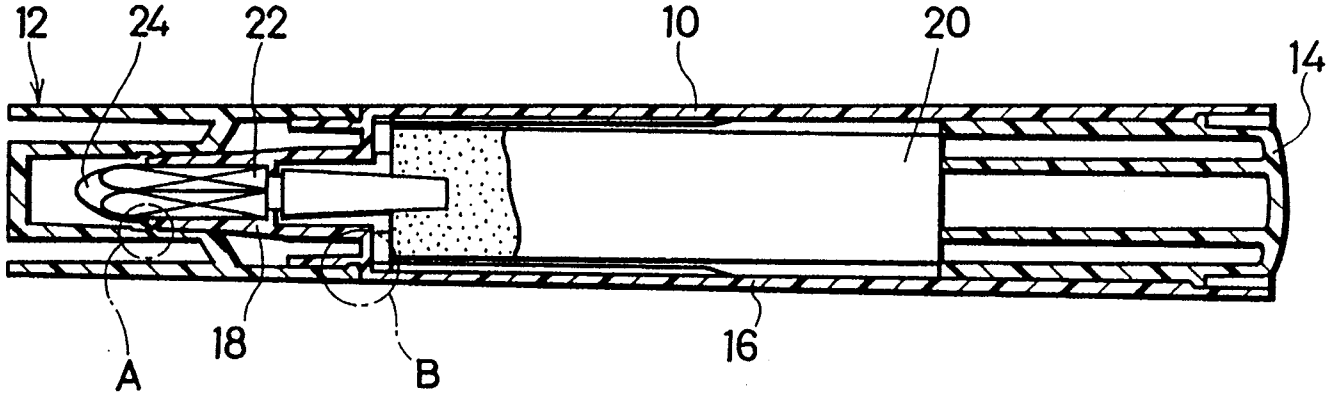
FIG. 2 is an overall sectional view of the liquid applicator.

A liquid applicator shown in FIG. 2 is provided with a main shaft 10 having a lead end portion mounted with a cap 12 and having a bottom end portion mounted with a bottom cap 14. The main shaft 10 includes a casing 16 of a large diameter. At a lead end of the casing 16 is formed continuously a hollow lead portion 18 of a diameter smaller than that of the casing 16. A pen core 20 is provided in the casing 16, and a nib body (liquid applying portion) 22 is fitted in the lead portion 18. This nib body 22 is connected with a lead end of the pen core 20, and a pen nib 24 projects out of a lead face of the lead portion 18.

There will be described the cap 12 and a structure of mounting the same next with reference to FIGS. 1A, 1B, and 3.

Figure 3A:
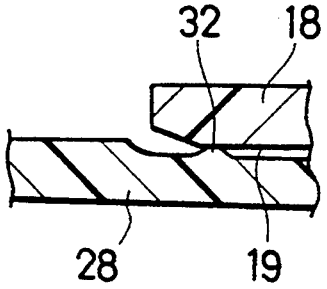
FIG. 3A is an enlarged view showing a portion A in FIG. 2.
Figure 3B:
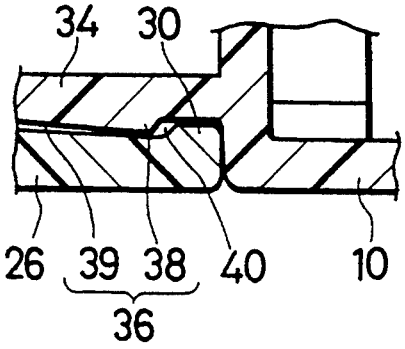
FIG. 3B is an enlarged view showing a portion B in FIG. 2.

The cap 12 is formed entirely of an elastically deformable material such as synthetic resin, and includes a hollow bottom side cylindrical portion 26 of a large diameter and a hollow lead side cylinder portion 28 of a small diameter. A lead end of the lead side cylinder portion 28 is sealed. On an inner circumferential surface of the bottom side cylindrical portion 26 at a bottom side is formed a line projection 30 projecting inward of the cap 12 and extending continuously over an entire circumference as shown in FIG. 3B (first cap fitting portion). On an inner circumferential surface of the lead side cylinder portion 28 at an intermediate portion is formed a line projection 32 projecting inward of the cap 12 and extending continuously over an entire circumference as shown in FIG. 3A (second cap fitting portion). An inside diameter of the projection 32 is slightly smaller than a diameter of an outer circumferential surface 19 (second shaft fitting portion) of a lead end of the lead portion 18. An interior of the lead side cylinder portion 28 is held airtight in a state where the projection 32 is engaged with (pressed against) the outer circumferential surface 19.

A hollow cylindrical cap mounting portion 34 extends from the lead end face of the main shaft 10 (the left side in FIGS. 1 to 3). On an outer circumferential surface of the cap mounting portion 34 is formed a projected portion 36 (first shaft fitting portion) which projects outward and has a top portion 38 at a bottom side as shown in FIG. 3B. This projected portion 36 has a tapered outer circumferential surface 39 whose diameter is increased continuously gradually as it extends from the lead end thereof to the top portion 38, a projected amount is increased continuously. At the bottom side of the top portion 38 is formed a groove 40.

The inside diameter of the projection 30 of the cap 12 is set smaller than the outside diameter of the top portion 38 of the projected portion 36 and larger than the outside diameter of the groove 40. Accordingly, the projection 30 is allowed to move to the lead face of the main shaft 10 over the top portion 38 as the bottom side cylindrical portion 26 and the cap mounting portion 34 deform elastically. An axial dimension of the groove 40 is set larger than an axial dimension of the projection 30, such that the projection 30 is located in contact with the lead face of the main shaft 10 apart from the top portion 38 after moving over the top portion 38 as shown in FIG. 3B.

Figure 1A:
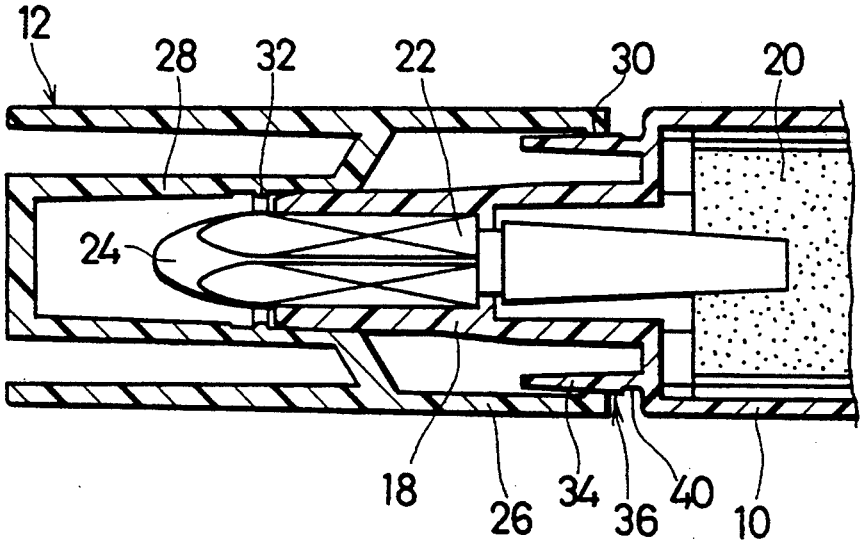
FIG. 1A is a sectional view showing a state where a line of projection formed on a cap is in contact with a tapered outer circumferential surface of a main shaft of a liquid applicator in an embodiment of the invention.
Figure 1B:
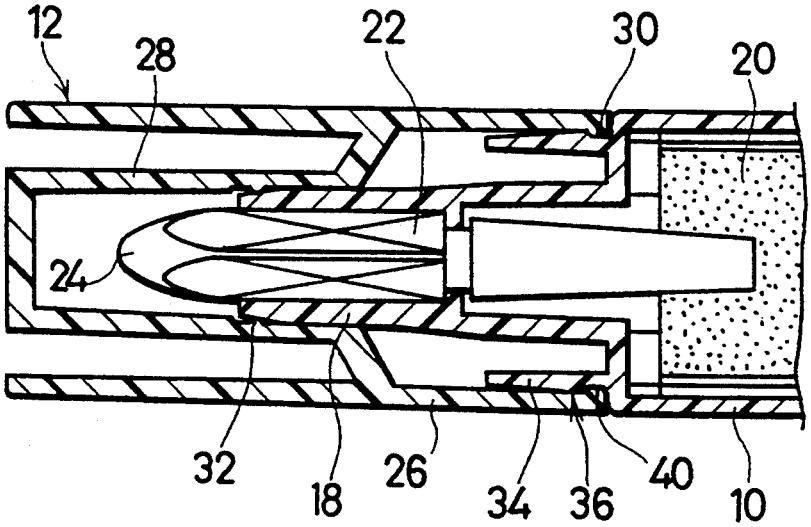
FIG. 1B is a sectional view showing a state where the projection of the cap has moved over a top of a projected portion formed on the main shaft.

The respective portions of the cap 12 and the main shaft 10 are positioned relative to one another such that the projection 32 is engaged with the outer circumferential surface 19 of the lead portion 18 as shown in FIG. 1B after the top portion 38 is spaced apart from the projection 30 as shown in FIG. 3B, i.e., that the projection 32 is not in contact with the outer circumferential surface 19 until the projection 30 moves over the top portion 38 and away therefrom toward the bottom end of the cap 12.

Operation of this liquid applicator will be described next.

When the lead end portion of the main shaft 10 is inserted to the cap 12 through the bottom end of the cap 12, the projection 30 of the cap 12 comes to contact with the tapered outer circumferential surface 39 of the projected portion 36 (a state shown in FIG. 1A). At this state, an interior of the cap 12 is held airtight by the contact of the projection 30 with the surface 39. Thereafter, when an external force is applied to the cap 12 forcibly in an axial direction of the liquid applicator so as to push the cap 12 over the lead end portion of the main shaft 10, the projection 30 moves over the tapered outer circumferential surface 39 toward the bottom end of the liquid applicator while bending and deforming the bottom side cylindrical portion 26 and the cap mounting portion 34. Consequently, the projection 30 reaches the groove 40 over the top portion 38. After moving over the top portion 38, the projection 30 is spaced away from the top portion 38 toward the bottom end of the liquid applicator. At a moment when the projection 30 is spaced away from the top portion 38, the air in the cap 12 escapes into the atmosphere through a clearance defined by the projection 30, the top portion 38, and the outer circumferential surface of the groove 40. The projection 32 is fitted to the outer circumferential surface 19 of the lead portion 18 immediately thereafter, and the interior of the cap 12 is sealed again (a state shown in FIG. 1B) .

Figure 6:
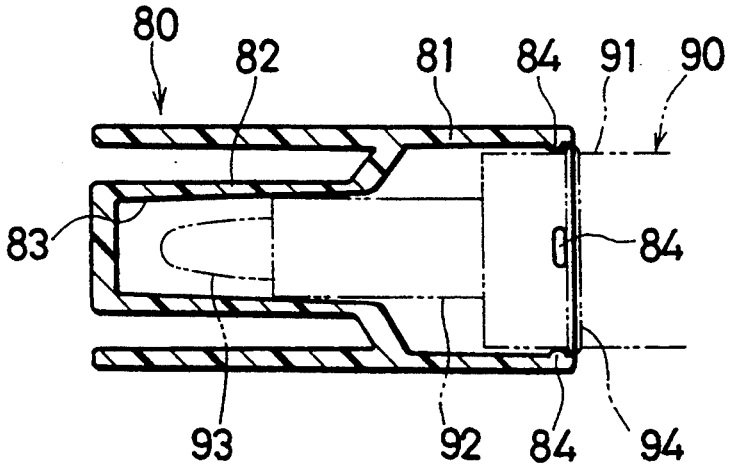
FIG. 6 PRIOR ART
FIG. 6 is a sectional view showing a cap of a conventional liquid applicator.

As described above, in the above liquid applicator, the projection 32 is fitted to the outer circumferential surface 19 of the lead portion 18 after the projection 30 moves over the top portion 38 of the projected portion 36. Accordingly, the axially acting external force required to move the corresponding projections over each other (i.e., the fitting strength) is smaller compared to the liquid applicator shown in FIG. 6 in which the lead portion 92 is fitted to the lead cylindrical portion 82 while the corresponding projections are moving over each other. Thus, even in the case where a circumferentially continuous projection 30 as shown in FIGS. 1, 3 is formed in place of the circumferentially spaced apart ribs 84 as shown in FIG. 6, an excessively large fitting strength is not required to mount the cap to the main shaft completely.

In mounting the cap 12, even if the user mistakenly determines that the cap mounting operation has been completed when the projection 30 comes to contact with the tapered outer circumferential surface 39 (i.e., before the projection 30 moves over the top portion 38) and stops this operation halfway, the projection 30 is in contact with the tapered outer circumferential surface 39 entirely over its circumference. Therefore, the airtightness in the cap 12 is attained while preventing the nib 24 from getting dry and the liquid to be applied from evaporating from the pen core 20.

In this embodiment, the projection 32 is fitted to the outer circumferential surface 19 after the projection 30 moves over the top portion 38 and is spaced away therefrom to the bottom end of the liquid applicator. Accordingly, the air in the cap 12 is allowed to escape into the atmosphere during a time which lasts until the projection 32 is fitted to the outer circumferential surface 19 after the projection 30 moves over the top portion 38 completely. Thus, an interior of the bottom side cylindrical portion 26 is prevented from being pressed excessively according to the axial displacement of the cap 12 after the projection 32 is fitted to the outer circumferential surface 19. As a result, there can be prevented the problem caused by the excessive pressure in the portion 26, i.e. an excessive flow of the liquid to be applied caused by a drastic pressure reduction of the air surrounding the pen nib 24 from a high level to an atmospheric level when the cap 12 is detached from the main shaft 10.

Figure 4:
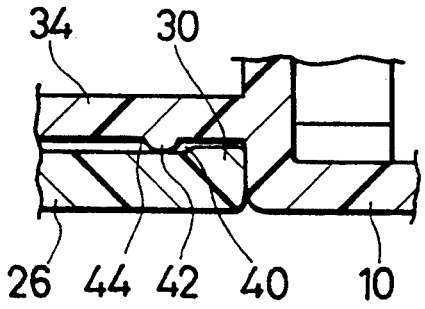
FIG. 4 is a sectional view showing a modification of a fitting structure of the cap and the main shaft.

In the foregoing embodiment, the projected portion 36 having the tapered outer circumferential surface is formed on the outer circumferential surface of the cap mounting portion 34. However, it may be appropriate to form a line projection 42 extending over the outer circumference of the cap mounting portion 34 as shown in FIG. 4 in place of the projected portion 36. In the case where this projection 42 is formed, protuberances such as lands are liable to be formed at a lead side base (a left base in FIG. 4) 44 of the projection 42. This may impair a contact between the projections 30, 42, i.e. the airtightness in the cap 12. However, if the projected portion 36 having the tapered outer circumferential surface as shown in FIG. 3B is formed, the lands or the like are not formed and thus the projection 30 is advantageously brought into contact with the tapered outer circumferential surface 39 more reliably (i.e., the interior of the cap 12 is sealed reliably) when the projection 30 moves over the projected portion 36.

Figure 5:
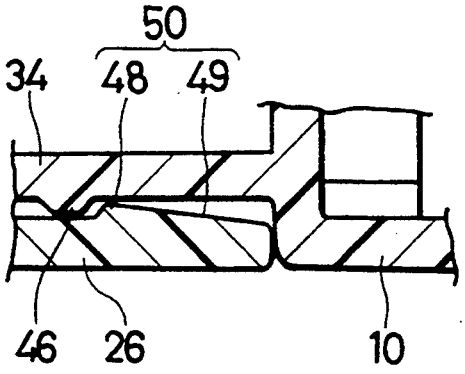
FIG. 5 is a sectional view showing another modification of the fitting structure of the cap and the main shaft.

The projected portion having the tapered surface is not necessarily formed at the main shaft 10. As shown in FIG 5, it may be suitable to form a top portion 48 and a projected portion 50 having a tapered inner circumferential on an inner circumferential surface of the bottom side cylindrical portion 26 of the cap 12 and to form a projection 46 movable over the top portion 48 on the outer circumferential surface of the cap mounting portion 34. In this case, the tapered inner circumferential surface 49 may be formed so that a diameter thereof increases continuously as the projected portion 50 extends toward the top portion 48 from the bottom end of the cylindrical portion 26 (i.e., a projected amount of the projected portion 50 increases).

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A liquid applicator comprising:

a main shaft having a first lead end and a second end;

a liquid applying portion at the first lead end;

first and second shaft fitting portions formed on the main shaft at the first lead end;

a cap detachably mounted on the lead end of the main shaft, the cap covering the liquid applying portion;

first and second cap fitting portions formed on the cap;

the first shaft fitting portion and the first cap fitting portion movable over each other thereby mounting the cap on the lead end of the main shaft while permitting air flow from the interior of the cap after temporarily sealing the interior of the cap, the second shaft fitting portion and the second cap fitting portion engageable with each other and thereby airtightly enclosing the liquid applying portion in an engaged state, and the first shaft and the first cap fitting portion and the second shaft and the second cap fitting portion positioned relative to each other such that the second shaft and the second cap fitting portions are engageable with each other only after the first shaft and the first cap fitting portions move over each other.

2. A liquid applicator according to claim 1, wherein the first shaft and cap fitting portions are disposed closer to the bottom end of the liquid applicator than the second shaft and cap fitting portions.

3. A liquid applicator according to claim 2, wherein the first shaft fitting portion is formed with a tapered surface projecting outward in a direction extending toward the first lead end, and the first cap fitting portion is formed to contact the tapered surface of the first shaft fitting portion over its entire circumference to seal the interior of the cap when the cap is fully contacted with the shaft.

4. A liquid applicator according to claim 2, wherein the first cap fitting portion is formed with a tapered surface projecting outward in a direction extending toward the interior closed end of the cap, and the first shaft fitting portion is formed to contact the tapered surface of the first cap fitting portion over its entire circumference to seal the interior of the cap when the cap is fully contacted with the shaft.

5. A liquid applicator according to claim 1, wherein the cap further comprises:

a first cap fitting portion moveable over the first shaft fitting portion, which contacts the entire circumference thereof and temporarily seals the interior of the cap;

a second cap fitting portion, disposed between a closed end of the cap and the first cap fitting portion and engaging with the second shaft fitting portion only after the first cap fitting portion moves over the first shaft fitting portion to permit air flow from the interior of the cap.

6. A liquid applicator according to claim 5, wherein the first cap fitting portion is formed with a tapered surface projected outward in a direction extending toward the closed end of the cap, and wherein the first shaft fitting portion contacts the tapered surface over the entire circumference before reaching the closed end of the cap.

* * * * *